United States Patent [19]

Allen

[11] Patent Number: 4,872,271

[45] Date of Patent: Oct. 10, 1989

[54] SHOE HEEL SCUFF PROTECTOR

[76] Inventor: Dorothy E. Allen, 18710 Fenelon, Detroit, Mich. 48234

[21] Appl. No.: 255,849

[22] Filed: Oct. 11, 1988

[51] Int. Cl.[4] ..... A43B 13/22

[52] U.S. Cl. ..... 36/72 B; D2/277

[58] Field of Search ..... 36/72 B, 72 R, 73; D2/271, 277

[56] References Cited

U.S. PATENT DOCUMENTS

| | | | |
|---|---|---|---|
| D. 288,382 | 2/1987 | Birchwood | D2/277 |
| 1,531,493 | 3/1925 | Maxon | 36/72 B |
| 1,945,420 | 1/1934 | Charles | 36/72 B |
| 2,853,805 | 9/1958 | Dratman | D2/271 |
| 4,665,633 | 5/1987 | Edgerton | 36/72 R |

FOREIGN PATENT DOCUMENTS

| | | | |
|---|---|---|---|
| 623606 | 8/1961 | Italy | 36/72 B |
| 2195228 | 4/1988 | United Kingdom | 36/72 B |

*Primary Examiner*—Werner H. Schroeder
*Assistant Examiner*—D. Biefeld
*Attorney, Agent, or Firm*—Brooks & Kushman

[57] ABSTRACT

A shoe heel scuff protector for the heel and counter portions of a women's shoe which prevents marring caused by contact with the floor of an automobile while driving. The protector is comprised of upper and lower endless elastic bands interconnected by an endless wall or sleeve. Installation of the protector on the shoe is facilitated by a pull-on loop. The upper endless band grips the shoe around the back of the counter and under the shank. The lower endless band grips the shoe about the top of the heel adjacent the bottom of the counter. The wall fits loosely over the shoe between the endless bands.

16 Claims, 1 Drawing Sheet

SHOE HEEL SCUFF PROTECTOR

BACKGROUND

It is well-known that the heel and counter portions of a motorist's shoe can be marred while driving by contact with carpeting, dirt and gravel on the automobile's floor. This problem is particularly objectionable with high-heel shoes which are usually held against the floor at the side of the counter of the shoe when operating the accelerator or other foot pedals.

A wide variety of heel protection devices are well-known in the art. Problems associated with these devices are that they are difficult to install and remove. Prior art devices may be incompatible with a wide variety of shoe types. Further, prior art devices have a tendency to either slip out of position due to an inadequate grip or mar the shoe due to an excessive grip.

SUMMARY OF THE INVENTION

The heel protector of the present invention comprises a cover which fits over the heel and counter portions of a women's shoe. The protector is quickly and easily installed and removed by means of a rearward pull-on loop. The protector maintains the proper position on the shoe by means of upper and lower endless elastic bands interconnected by a generally frustoconical endless elastic wall or sleeve. The upper endless band grips the shoe around the back of the counter and under the shank. The lower endless band grips the shoe about the top of the heel adjacent the counter. The wall is gathered at its upper and lower edges where it joins the bands giving it an irregular or gathered surface which allows the device to loosely cover those portions of the shoe between the endless bands. The endless bands maintain an adequate grip without causing damage to the shoe. The loose fit of the wall allows it to be shiftable relative to the shoe without causing the protector to slip out of position.

Accordingly, it is a principal object of this invention to prevent the marring o the heel and counter portions of a motorist's shoe that can occur while driving.

Another object of this invention is to provide a protective device that is quickly and easily installed upon and removed from the shoe.

Another object of this invention is to provide a protective device that is compatible with a wide variety of shoes.

Another object of this invention is to provide a protective device that maintains the proper position without damaging the shoe structure due to excessive gripping force.

Another object of this invention is to provide a protective device that is simple in design, inexpensive to manufacture and durable in construction.

Another object of this invention is to provide a protective device that is small and flexible for easy storage in a wide variety of places.

These and other objects and advantages will be apparent after consideration of the following detailed description and drawings.

DETAILED DESCRIPTION

Figure 1:
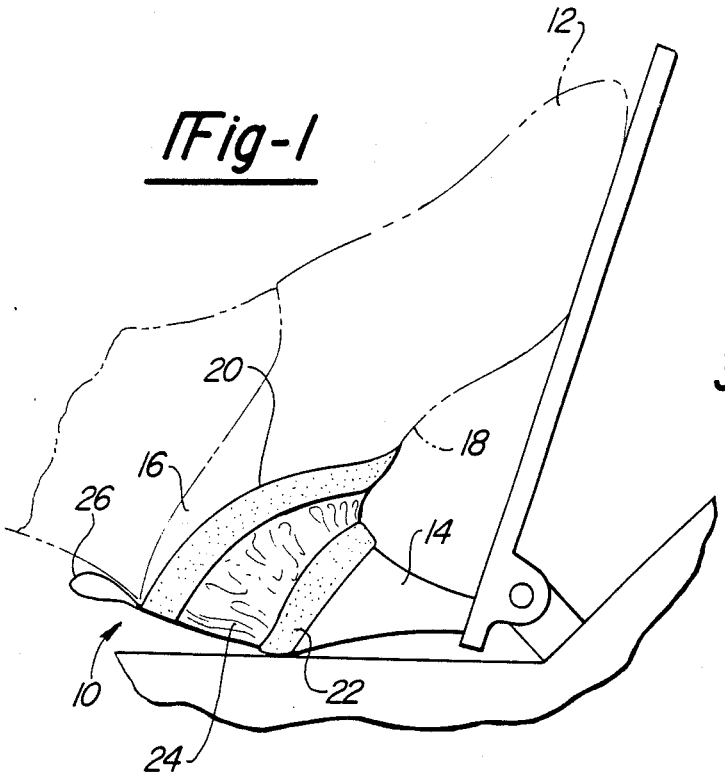
FIG. 1 is a perspective view of a woman's high-heel shoe having the heel protector of the present invention secured to the shoe.

Referring now to FIG. 1, the heel protector 10 of the present invention is shown attached to a shoe 12 having a heel 14, a counter 16 and a shank 18. The heel protector is fitted over the heel 14 under the shank 18 and across the back of the counter 16.

Referring now to FIGS. 1 through 4, the heel protector 10 includes an upper endless band 20 which is preferably formed of an elastomeric material. A lower endless band 22 is secured to the lower end of the heel protector 10, and is likewise formed of an elastomeric material. The elastic bands 20, 22 are preferably formed from an elastomeric material having sufficient elasticity to grip the shoe. The upper band 20 and lower band 22 are interconnected by an endless elastic wall, or sleeve, 24.

Figure 2:
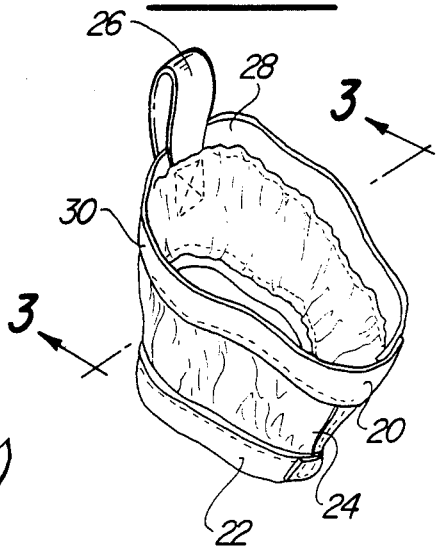
FIG. 2 is a perspective view of the heel protector of the present invention.

The elastic bands 20,22 preferably have sufficient elastic memory to maintain an open configuration when not installed on a shoe. The open configuration shown in FIG. 2 is representative of the shape normally assumed by the new protector 10 when not attached to a shoe. The endless elastic wall 24 is generally frustoconical in shape when not installed on the shoe but conforms to the shape of the shoe when installed on the shoe. The elastic wall 24 is preferably thinner than the upper and lower bands. The wall as shown in FIGS. 1 through 4 is gathered to allow the wall 24 to be shiftable relative to the shoe without causing slippage of the upper and lower endless bands 20 and 22.

Fitting the heel protector 10 to different types of shoes is facilitated by the fact that the alignment and spacing of the endless bands may be changed with the endless wall 24 either stretching or collapsing to accommodate the changes.

Figure 3:
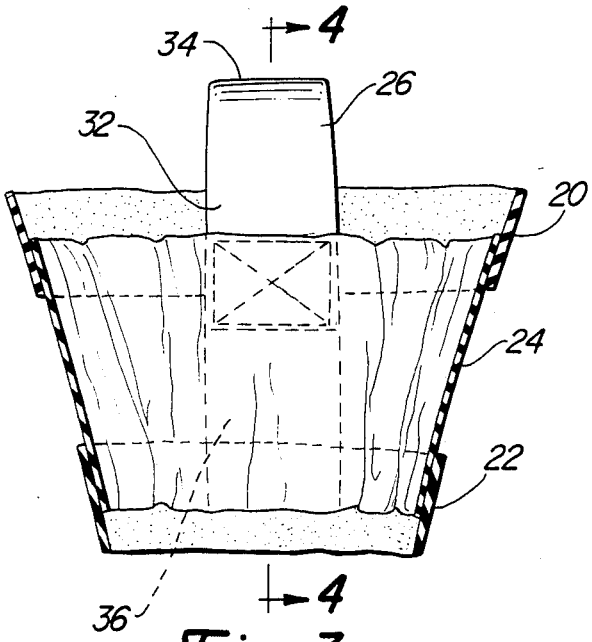
FIG. 3 is a cross-sectional view taken along the line 3—3 in FIG. 2.
Figure 4:
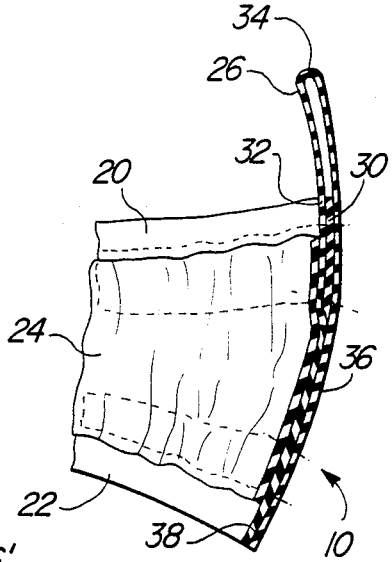
FIG. 4 is a cross-sectional view taken along the line 4—4 in FIG. 3.

A flexible loop 26 is affixed to the rear of the heel protector 10 as shown in FIGS. 2 through 4. The loop 26 is grasped by the wearer's finger and used to pull the heel protector 10 onto the heel 14 of the shoe 12 and up over the counter 16. The loop 26 is secured to the inner surface 28 of the upper band 20 and extends upwardly from the upper band 20 before looping back to be secured to the outer surface 30 of the upper band 20. Referring more specifically to FIG. 4, the preferred method of attaching the loop 26 to the heel protector 10 is shown wherein one end 32 of the loop 26 is secured between the upper band 20 and the flexible wall 24 by known means such as sewing. The first end extends upwardly to a reversely bent portion 34 and then extends across the outer surface 30 of the upper band 20 and down to the outer surface 38 of the lower band 22. In this preferred method of attaching the loop 26 to the heel protector 10, the stresses of stretching the heel protector over the shoe 12 are spread over the upper band 20, the lower band 22 and the wall 24. The double securement to the upper band 20 is intended to minimize any tendency of the loop to separate or tear away from the upper band 20.

Figure 5:
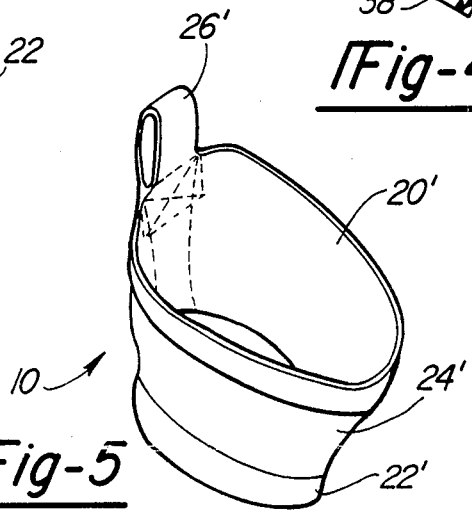
FIG. 5 is a perspective view of an alternative embodiment of the heel protector of the present invention.

Referring now to FIG. 5, an alternative embodiment of the heel protector 10, features a smooth wall 24' which extends between the upper band 20' and lower band 22'. The flexible loop 26' is secured to both the upper band 20' and the lower band 22'. The flexible loop 26' may be sewn onto the heel protector or molded as a region of increased thickness across the rear of the heel protector. The embodiment of FIG. 5 may be molded as an integral unit with the upper and lower band 20' and 22', the wall 24' and the flexible loop 26' being molded as a unitary piece from an elastomeric material.

It is to be understood that the embodiments of this invention as shown and described are preferred examples and that the invention is not to be limited to the exact arrangement of parts shown in the accompanying drawings or described in the specification. Various changes in the details of the construction and shape of the elements of the preferred embodiments may be made without departing from the spirit of the invention. The scope of the novel concepts of the invention are defined in the following claims.

I claim:

1. A protective device for a shoe having a heel, a shank and a counter comprising:

an upper elastic endless band;

a lower elastic endless band being smaller in circumference than the upper band;

said upper and lower bands being effective to grip the shoe adjacent the heel and counter, the upper band being disposed around the shoe counter and shank, the lower band being disposed around the shoe heel adjacent the counter;

an endless elastic wall interconnecting the upper and lower bands respectively and being gathered at its upper and lower edges for shielding the shoe heel and counter; and a flexible loop extending across and upwardly from the upper band's inner surface, said loop being reversely bent and continuing downward across the upper band's outer surface wherein said loop serves as a pull for the installation of the device over the shoe heel and counter.

2. The protective device of claim 1 wherein said endless bands are resilient and maintain an open configuration prior to installation on a shoe to facilitate guiding the device into position over the heel.

3. The protective device of claim 1 wherein said endless bands, endless wall and loop are molded integrally in one piece.

4. The protective device of claim 1 wherein said endless bands are sewn to the wall and the loop is sewn to at least one of said endless bands.

5. The protective device of claim 1 wherein said endless bands are of increased thickness relative to the wall to resist tearing as the device is installed on a shoe.

6. The protective device of claim 1 wherein said endless wall between said endless bands is loosely fitted to the shoe to permit slippage of said wall relative to the shoe.

7. The protective device of claim 1 wherein said wall stretches to allow the upper and lower endless bands to assume a position on the shoe of greater spacing than when not installed on a shoe and said wall collapses to allow the upper and lower endless bands to assume a position on the shoe of less spacing than when not installed on a shoe.

8. A protective device for a shoe having a heel, a shank and a counter comprising:

a generally frustoconically shaped endless wall having endless bands at its upper and lower edges of increased wall thickness relative to the wall between the endless bands, said wall being formed of elastic material wherein said endless bands comprised of elastic material and serving to grip the shoe with the upper band gripping the shoe around the counter and shank and the lower band gripping the shoe around the heel adjacent the counter; and a flexible loop extending upwardly from the upper band, curving over and continuing downwardly to the upper band to form a loop wherein a finger pull is provided for installation of the device over the shoe.

9. The protective device of claim 8 wherein the wall is gathered adjacent the endless bands to accommodate expansion of the endless bands.

10. The protective device of claim 8 wherein said endless bands are resilient and maintain an open configuration prior to installation on a shoe to facilitate guiding the device into position over the heel.

11. The protective device of claim 8 wherein said sleeve including said endless bands and said loop are molded integrally in one piece.

12. The protective device of claim 8 wherein said endless bands are sewn to the wall and the loop is sewn to at least one of said endless bands.

13. The protective device of claim 8 wherein said endless bands are of increased thickness relative to said wall to resist tearing as the device is installed on a shoe.

14. The protective device of claim 8 wherein said wall between said endless bands is loosely fitted to the shoe to permit slippage of said sleeve relative to the shoe.

15. The protective device of claim 8 wherein said wall is resilient and maintains a generally frustoconical shape until installed on a shoe.

16. The protective device of claim 8 wherein said wall stretches to allow the upper and lower endless bands to assume a position on the shoe of greater spacing than when not installed on a shoe and said wall collapses to allow the upper and lower endless bands to assume a position on the shoe of less spacing than when not installed on a shoe.

* * * * *